US009610681B1

(12) United States Patent
Ou

(10) Patent No.: US 9,610,681 B1
(45) Date of Patent: Apr. 4, 2017

(54) TOOL HOLDER

(71) Applicant: Yu-Hua Ou, Taichung (TW)

(72) Inventor: Yu-Hua Ou, Taichung (TW)

( * ) Notice: Subject to any disclaimer, the term of this patent is extended or adjusted under 35 U.S.C. 154(b) by 0 days.

(21) Appl. No.: 14/954,408

(22) Filed: Nov. 30, 2015

(51) Int. Cl.
*B25H 3/04* (2006.01)
*A47F 7/00* (2006.01)
*B25H 3/00* (2006.01)

(52) U.S. Cl.
CPC ..... *B25H 3/04* (2013.01); *A47F 7/0028* (2013.01); *B25H 3/003* (2013.01)

(58) Field of Classification Search
CPC ..... A47F 7/024; A47F 7/0021; A47F 7/0028; B25H 3/003; B25H 3/04; B25H 3/00; B25H 3/06; B25H 3/006; B25H 3/02
USPC ..... 211/70.6, 60.1; 206/349, 372, 376, 377, 206/378, 493
See application file for complete search history.

(56) References Cited

U.S. PATENT DOCUMENTS 5,906,350 A * 5/1999 Kao ..... A47F 7/0028 206/349
6,079,559 A * 6/2000 Lee ..... A47F 5/0006 206/372
6,092,655 A * 7/2000 Ernst ..... B25H 3/003 206/378
6,092,656 A * 7/2000 Ernst ..... B25H 3/06 206/378
6,098,799 A * 8/2000 Lee ..... B25H 3/003 206/350
6,364,109 B1 * 4/2002 Blackwell ..... B65D 85/20 206/378
6,508,360 B1 * 1/2003 Chen ..... B25H 3/003 206/349
6,536,611 B2 * 3/2003 Chen ..... B25H 3/04 211/70.6
6,834,767 B1 * 12/2004 Lin ..... B25H 3/00 206/349
7,100,777 B1 * 9/2006 Kao ..... B25H 3/04 206/372
7,938,261 B1 * 5/2011 Lee ..... B25H 3/04 206/349
9,126,739 B2 * 9/2015 Chao-Ming ..... B65D 85/02
2003/0024837 A1 * 2/2003 Chen ..... B25H 3/003 206/378

(Continued)

*Primary Examiner* — Daniel J Troy
*Assistant Examiner* — Hiwot Tefera
(74) *Attorney, Agent, or Firm* — Muncy, Geissler, Olds & Lowe, P.C.

(57) ABSTRACT

A tool holder is provided for at least one connection rod to be assembled thereto. Each connection rod has a body portion and a tubular portion greater than the body portion in radial dimension, and a stepped portion is formed between the tubular and body portions. The tool holder includes a main body and a positioning member. The main body includes a hanging portion, an assembling portion and an abutting portion, the assembling portion includes at least one engaging block for one said tubular portion to be engaged therewith, and the abutting portion is for radially abutting against the body portion. The positioning member is assembled to the main body, a side of the positioning member facing the abutting portion is for radially abutting against the body portion, and an end of the positioning member facing the assembling portion is for abutting the stepped portion.

5 Claims, 5 Drawing Sheets

(56) References Cited

U.S. PATENT DOCUMENTS

| | | | | |
|---|---|---|---|---|
| 2008/0053853 | A1* | 3/2008 | Kao | B25H 3/003 206/377 |
| 2010/0170817 | A1* | 7/2010 | Wu | B25H 3/04 206/378 |
| 2010/0258515 | A1* | 10/2010 | Chen | A47F 7/00 211/70.6 |

* cited by examiner

TOOL HOLDER

BACKGROUND OF THE INVENTION

Field of the Invention

The present invention relates to a tool holder, and more particularly to an anti-theft tool holder.

Description of the Prior Art

Usually, when a connection rod is in storage or put on shelves, the connection rod is assembled to a tool holder, and then, the tool holder is placed on the wall or the display board. A conventional tool holder has a board portion, a conventional connection rod has a body portion and a tubular portion connected to an end of the body portion, and the tubular portion is greater than the body portion in radial dimension. When the connection rod is assembled to the tool holder, the tubular portion is placed on the board portion, and the body portion of the connection rod is bound to the board portion of the tool holder with a band. When the tool holder is hung, the band abuts against a stepped portion formed between the tubular portion and the body portion so as to prevent the connection rod from being disengaged with the tool holder.

However, in the conventional tool holder, the connection rod is bound to the board portion with the band, and it is inconvenient to bind the connection rod. In addition, to take the connection rod from the tool holder, one only has to move the tubular portion of the connection rod toward a direction away from the band. Then, the body portion can be taken out from the band, and the connection rod can be disengaged with the tool holder. The conventional tool holder is not anti-theft, and the connection rod on shelves may be stolen easily.

The present invention has arisen to mitigate and/or obviate the afore-described disadvantages.

SUMMARY OF THE INVENTION

The major object of the present invention is to provide a tool holder for a connection rod to be assembled thereto, and the tool holder can prevent a connection rod from being disengaged with the tool holder. Therefore, the tool holder is anti-theft.

To achieve the above and other objects, a tool holder is provided for at least one connection rod to be assembled thereto, each said connection rod has a body portion and a tubular portion connected to an end of the body portion, the tubular portion is greater than the body portion in radial dimension, a stepped portion is formed between the tubular portion and the body portion, and the tool holder includes a main body and a positioning member. The main body includes a hanging portion, an assembling portion and an abutting portion. The assembling portion includes at least one engaging block which protrudes toward the abutting portion for one said tubular portion to be engaged therewith, and the abutting portion is for radially abutting against the body portion of each said connection rod. The positioning member is assembled to the main body, a side of the positioning member facing the abutting portion is for radially abutting the body portion of each said connection rod, and an end of the positioning member facing the assembling portion is for abutting against the stepped portion of each said connection rod.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
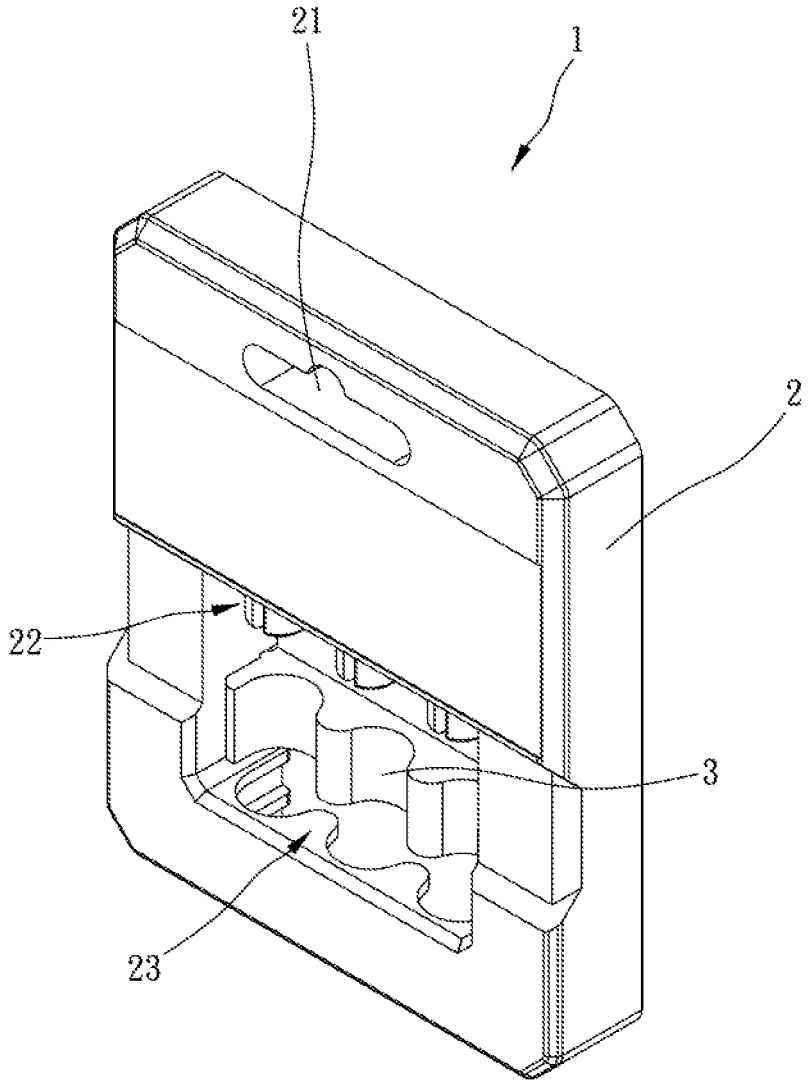
FIG. 1 is a perspective view of a preferred embodiment of the present invention.
Figure 2:
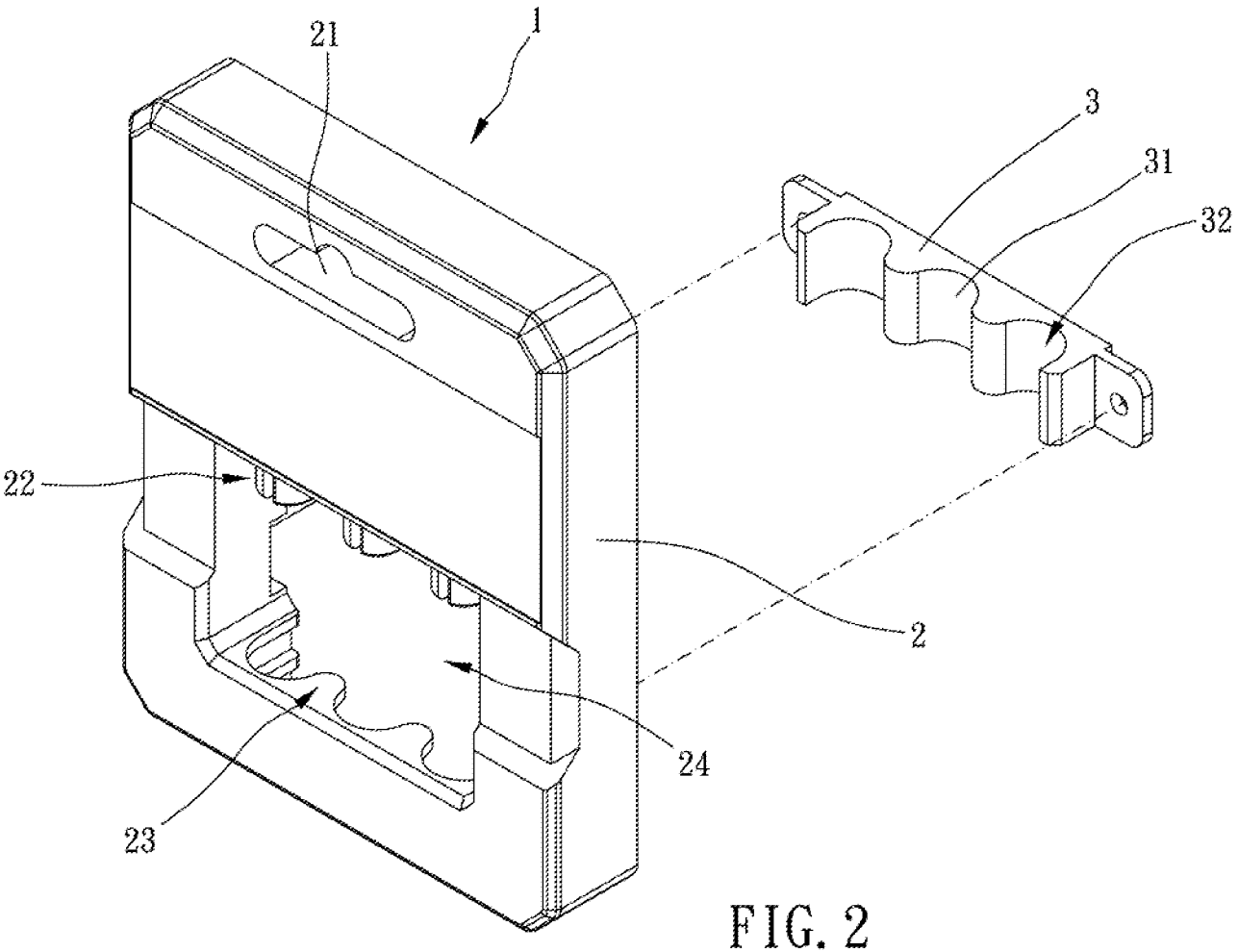
FIGS. 2 and 3 are breakdown views of the preferred embodiment of the present invention.
Figure 3:
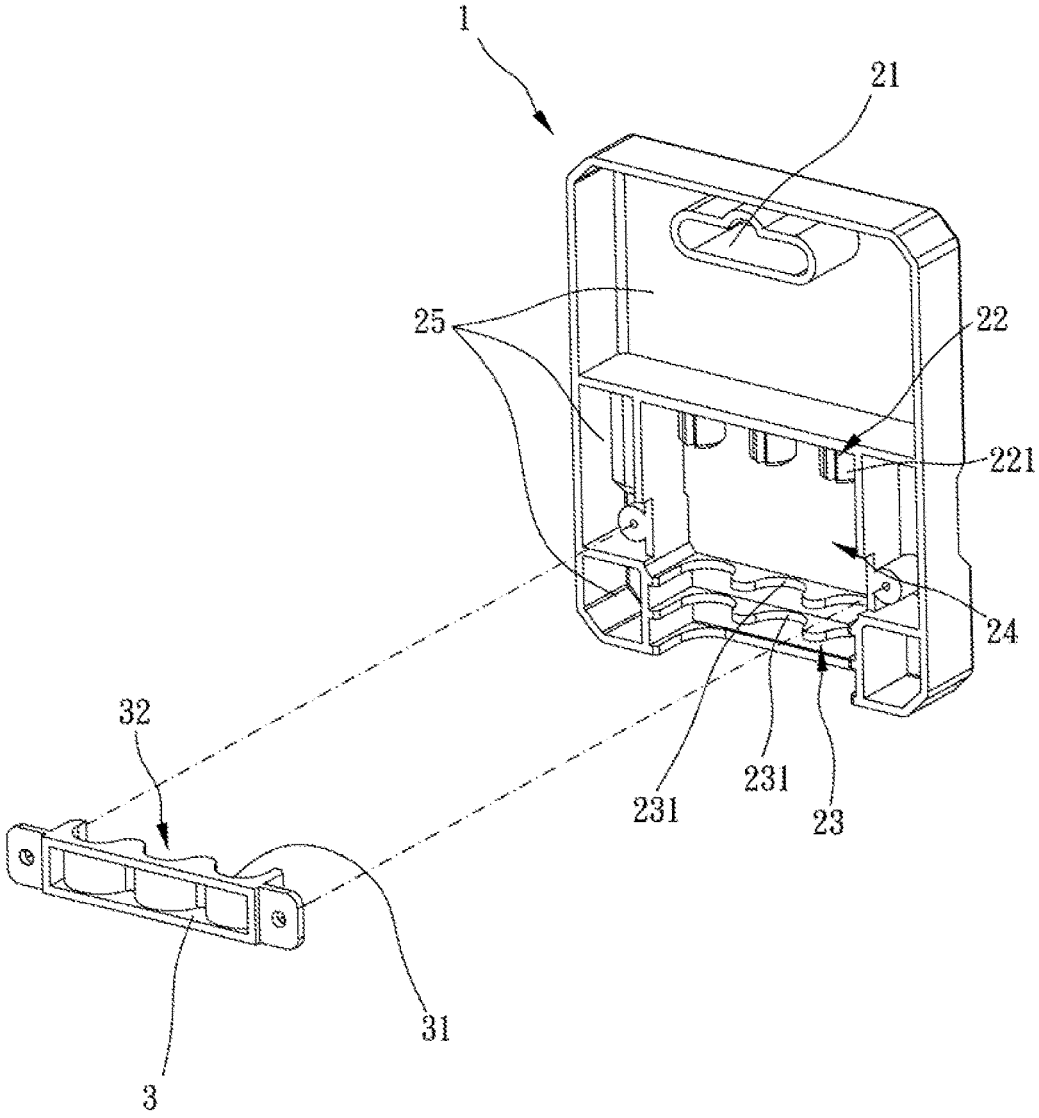
Figure 4:
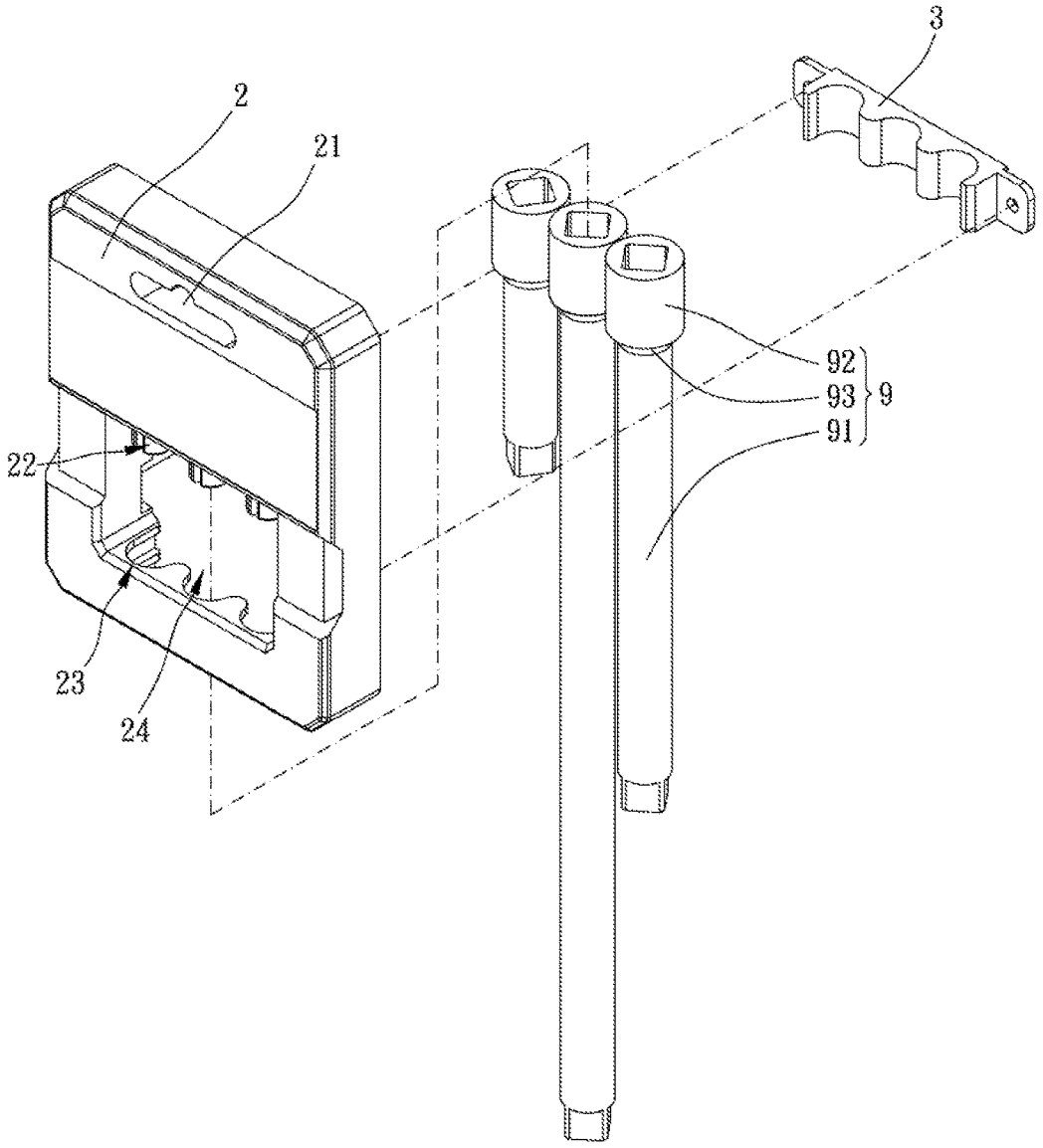
FIG. 4 is a drawing showing an assembly of the preferred embodiment of the present invention.
Figure 5:
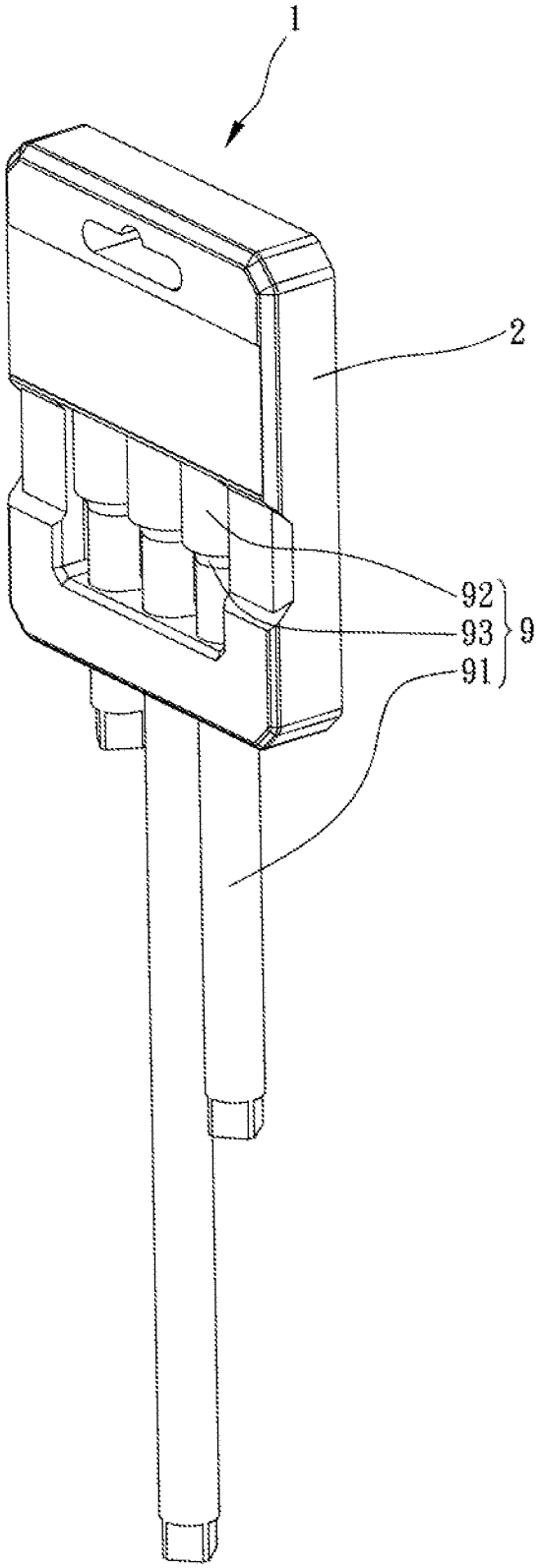
FIG. 5 is a drawing showing the preferred embodiment of the present invention in use.

Please refer to FIGS. 1 to 5 for a preferred embodiment of the present invention. A tool holder 1 is provided for at least one connection rod 9 to be assembled thereto, each said connection rod 9 has a body portion 91 and a tubular portion 92 connected to an end of the body portion 91, the tubular portion 92 is greater than the body portion 91 in radial dimension, a stepped portion 93 is formed between the tubular portion 92 and the body portion 91, and the tool holder 1 includes a main body 2 and a positioning member 3. In this embodiment, there are three connection rods 9, and the body portions 91 of the connection rods 9 have different lengths.

The main body 2 includes a hanging portion 21, an assembling portion 22 and an abutting portion 23. The assembling portion 22 includes at least one engaging block 221 which protrudes toward the abutting portion 23 for one said tubular portion 92 to be engaged therewith, and the abutting portion 23 is for radially abutting against the body portion 91 of each said connection rod 9.

The positioning member 3 is assembled to the main body 2, a side of the positioning member 3 facing the abutting portion 23 is for radially abutting the body portion 91 of each said connection rod 9, and an end of the positioning member 3 facing the assembling portion 22 is for abutting against the stepped portion 93 of each said connection rod 9. The tubular portion 92 of each said connection rod 9 is engaged with one said engaging block 221, and the stepped portion 93 of each said connection rod 9 is abutted by the end of the positioning member 3 facing the assembling portion 22, so the tubular portion 92 of each said connection rod 9 cannot be disengaged with one said engaging block 221, and each said connection rod 9 cannot be disengaged with the main body 2.

Preferably, the positioning member 3 is screwed to the main body 2 to prevent the positioning member 3 from being pulled out and prevent the connection rods 9 from being taken away. In other embodiments, the positioning member may be fastened to or engaged with the main body. It is to be noted that in this embodiment, two ends of the positioning member are screwed to the main body 2; and in other embodiments, an end of the positioning member may be pivoted to the main body 2, and the other end may be detachably assembled to the main body 2 so that each said connection rod 9 cannot be disengaged with the main body 2.

In addition, in this embodiment, the abutting portion 23 further includes at least one first recess 231 for the body portion 91 of one said connection rod 9 to be received therein, and the positioning member 3 includes at least one second recess 31 which faces the at least one first recess 231 and is for the body portion 91 of one said connection rod 9 to be received therein. In this embodiment, the first recesses 231 correspond to the connection rods 9 in number, and the abutting portion 23 has at least two said first recesses 231 which are arranged spacingly in parallel and correspond to each other. The body portion 91 of each said connection rod 9 is arranged between the second recess 31 and the two first recesses 231 so that each said connection rod 9 can be assembled to the main body 2 stably. Preferably, in this embodiment, the positioning member 3 is disposed between the at least one engaging block 221 and the abutting portion 23, and as viewed in a direction from the at least one engaging block 221 toward the abutting portion 23, the positioning member 3 and the abutting portion 23 are shiftedly arranged so as to prevent each said connection rod 9 from shaking.

Specifically, the main body 2 may further include a receiving space 24 for the connection rods 9 to be received therein. In this embodiment, the receiving space 24 is rectangular, the engaging blocks 221 protrude into the receiving space 24, the abutting portion 23 is arranged traversely in the receiving space 24, and a side of the positioning member 3 facing the receiving space 24 is a waved structure 32. Preferably, the main body 2 may further include a plurality of hollow-out portions 25, and the hollow-out portions 25 are arranged around the receiving space 24. With the hollow-out portions 25, the weight of the main body 2 can be reduced, and the manufacturing cost of the main body 2 is lower.

Given the above, the tubular portion of each said connection rod is engaged with one said engaging block, and the stepped portion of each said connection rod is abutted by the end of the positioning member facing the assembling portion; therefore, the tubular portion of each said connection rod cannot be disengaged with one said engaging block, and each said connection rod cannot be disengaged with the main body. Thus, the tool holder is anti-theft.

While we have shown and described various embodiments in accordance with the present invention, it should be clear to those skilled in the art that further embodiments may be made without departing from the scope of the present invention.

What is claimed is:

1. A tool holder, provided for at least one connection rod to be assembled thereto, each said connection rod having a body portion and a tubular portion connected to an end of the body portion, the tubular portion is greater than the body portion in radial dimension, the tubular portion and the body portion forming a stepped portion therebetween, the tool holder including:

a main body, including a hanging portion, an assembling portion and an abutting portion, the assembling portion including at least one engaging block which protrudes toward the abutting portion for one said tubular portion to be engaged therewith, the abutting portion being for radially abutting against the body portion of each said connection rod;

a positioning member, assembled to the main body, a side of the positioning member facing the abutting portion being for radially abutting against the body portion of each said connection rod, an end of the positioning member facing the assembling portion being for abutting against the stepped portion of each said connection rod;

wherein the abutting portion includes at least one first recess for the body portion of one said connection rod to be received therein, the positioning member includes at least one second recess for the body portion of one said connection rod to be received therein, the first recess has an internal diameter equal to an internal diameter of the second recess;

wherein the positioning member is disposed between the at least one engaging block and the abutting portion.

2. The tool holder of claim 1, wherein the abutting portion has at least two said first recesses which are arranged spacingly in parallel and correspond to each other.

3. The tool holder of claim 1, wherein the positioning member is screwed to the main body.

4. The tool holder of claim 1, wherein the main body further includes a receiving space for the at least one connection rod to be received therein, the receiving space is rectangular, the at least one engaging block protrudes into the receiving space, the abutting portion is arranged traversely in the receiving space, and a side of the positioning member facing the receiving space is a waved structure.

5. The tool holder of claim 4, wherein the main body further includes a plurality of hollow-out portions, and the hollow-out portions are arranged around the receiving space.

* * * * *